US010538914B2

(12) United States Patent
Lehtonen

(10) Patent No.: US 10,538,914 B2
(45) Date of Patent: Jan. 21, 2020

(54) GLASS PANEL ARRANGEMENT AND A GUIDE TRACK FOR SUPPORTING A GLASS PANEL

(71) Applicant: LUMON INVEST OY, Kouvola (FI)

(72) Inventor: Markku Lehtonen, Kuusankoski (FI)

(73) Assignee: LUMON INVEST OY, Kouvola (FI)

( * ) Notice: Subject to any disclaimer, the term of this patent is extended or adjusted under 35 U.S.C. 154(b) by 0 days.

(21) Appl. No.: 16/125,105

(22) Filed: Sep. 7, 2018

(65) Prior Publication Data

US 2019/0100912 A1 Apr. 4, 2019

(30) Foreign Application Priority Data

Oct. 4, 2017 (FI) ..... 20175874

(51) Int. Cl.

| | |
|---|---|
| ***E04B 2/82*** | (2006.01) |
| ***E05B 65/08*** | (2006.01) |
| ***E06B 3/46*** | (2006.01) |
| ***E05D 15/06*** | (2006.01) |

(52) U.S. Cl.

CPC ..... *E04B 2/827* (2013.01); *E05B 65/087* (2013.01); *E05D 15/0686* (2013.01); *E06B 3/46* (2013.01)

(58) Field of Classification Search

CPC ..... E04B 2/827; E05D 15/0686; E06B 3/46; E06B 3/509; E06B 3/4681; E06B 5/10; E06B 7/28; E05B 65/087; E05F 7/04

USPC ..... 52/207

See application file for complete search history.

(56) References Cited

U.S. PATENT DOCUMENTS 1,799,482 A * 4/1931 Schlacks ..... E06B 1/36 49/394
2,638,190 A * 5/1953 Watkins ..... E06B 3/4618 52/207
2,788,097 A * 4/1957 Frick ..... E05D 15/0665 52/207
2,847,726 A * 8/1958 Frick ..... E06B 3/4609 52/207

(Continued)

FOREIGN PATENT DOCUMENTS

DE 3425484 A1 * 1/1986 ..... E04B 2/827
DE 102009027242 A1 * 12/2010 ..... E04B 2/827

(Continued)

OTHER PUBLICATIONS

Feb. 19, 2019 extended European Search Report issued in European Patent Application No. 18397523.4.

*Primary Examiner* — Jeanette E Chapman
(74) *Attorney, Agent, or Firm* — Oliff PLC

(57) ABSTRACT

A glass panel system including: a lower guide track and an upper guide track; and a first glass panel coupled to the lower guide track and the upper guide track in such a way that the first glass panel is movable along the lower guide track and the upper guide track in their longitudinal direction a guide track placed by the side of the first glass panel; and at least one locking element fastened to the first glass panel and configured to engage the guide track, along which the locking element is movable when the first glass panel is moving. When coupled to the guide track, the locking element supports the first glass panel and is configured to prevent any movement caused by bending of the first glass panel in either one lateral direction or two opposite lateral directions with respect to the guide track.

20 Claims, 4 Drawing Sheets

(56) References Cited

U.S. PATENT DOCUMENTS 2,869,187 A * 1/1959 Liebman ..... E06B 3/4618 52/207
3,208,110 A * 9/1965 Griffin ..... E06B 3/44 49/449
3,309,816 A * 3/1967 Malone, Jr. ..... E04B 2/827 49/127
3,491,483 A * 1/1970 Miller ..... E05D 15/0604 49/141
3,996,711 A * 12/1976 Pearson ..... E04H 3/14 52/207
4,535,578 A * 8/1985 Gerken ..... E06B 7/16 49/317
5,005,315 A * 4/1991 Jackson, Jr. ..... E04B 2/827 49/127
5,103,589 A * 4/1992 Crawford ..... E06B 3/4609 49/125
6,018,913 A * 2/2000 Lin ..... E05D 15/56 49/360
6,685,253 B1 * 2/2004 Wolcott ..... B60R 16/0207 296/155
7,207,141 B2 * 4/2007 Sullivan ..... E06B 7/32 119/481
8,261,500 B2 * 9/2012 Sprague ..... E04B 2/827 160/200
8,375,645 B2 * 2/2013 Iwauchi ..... E05D 15/1042 49/127
8,499,496 B2 * 8/2013 Picchio ..... E05D 15/0617 49/404
2007/0151179 A1 * 7/2007 Speyer ..... E06B 7/23 52/207
2007/0175121 A1 * 8/2007 Speyer ..... E05C 9/063 52/207
2010/0289299 A1 * 11/2010 Kitayama ..... E05D 15/1007 296/202
2014/0326419 A1 * 11/2014 Ona-Gonzalez .... E05D 15/0604 160/115
2015/0284949 A1 * 10/2015 Hilliaho ..... E06B 3/924 52/204.1

FOREIGN PATENT DOCUMENTS

EP 3168408 A1 5/2017
KR 10-0775020 B1 11/2007
KR 10-0806744 B1 2/2008
KR 10-1432557 B1 8/2014
WO 2014/068178 A1 5/2014
WO 2017/081364 A1 5/2017

* cited by examiner

GLASS PANEL ARRANGEMENT AND A GUIDE TRACK FOR SUPPORTING A GLASS PANEL

OBJECT OF THE SOLUTION

The object of the solution is a glass panel system.

BACKGROUND OF THE PRESENT SOLUTION

Various types of glass panel systems may be incorporated in buildings, for example, in conjunction with a balcony or terrace of a building. In many cases, a glass pan& is made of tempered glass and may comprise several laminated glass layers. A glass panel system typically comprises several glass panels which are preferably placed one after another and which in the closed position constitute a wall.

A glass panel system typically comprises an upper guide track and a lower guide track for guiding the travelling of the glass panel, one or more hinge dements and/or a guide element being placed within or on top of the guide tracks and fixed to the glass panel. The travelling of the glass panel is controlled by the hinge element and/or guide element, or the glass panel is suspended on the upper guide track by means of them, or the glass panel rests through them on the lower guide track which supports the panel. Typically, the glass panel may be movable along the upper and lower guide tracks by means of the said hinge element or guide element. Moving typically takes place manually by pushing.

The upper and lower guide tracks are normally installed in the horizontal position and fixed, for example, to structures of a building. The lower guide track may be positioned on floor level or higher. The glass panel is usually openable sideways and closable.

Two or more glass panels which are moved to a position in which they can be opened, may be placed next to each other in a bundle in the open position, whereby an open space is formed in the glass panel system, for example for ventilation or passage.

Some glass panel systems of prior art are disclosed in documents WO 2014/068178 A1, WO 2017/08813864 A1 and EP 3168408 A1.

Wind, blasts, storms, and air flows may often affect and load a glass panel, which is why sufficient strength is required of the glass panel, to prevent breaking of the glass panel. Improving the strength of the glass panel often leads to increasing the thickness of the glass panel, which may be problematic in view of manual handling of the glass panel, because the weight of the glass panel is increased as well.

A BRIEF SUMMARY OF THE SOLUTION PRESENTED

The glass panel system according to the solution comprises a lower guide track and an upper guide track which are substantially horizontal and parallel, and a first glass panel which is placed in a vertical position between the lower guide track and the upper guide track, and connected to the lower guide track and the upper guide track so that the first glass panel is movable along the lower guide track and the upper guide track in their longitudinal direction.

Furthermore, the glass panel system according to the solution comprises a guide track which is placed by the side of the first glass panel and is substantially horizontal and parallel with the upper guide track and the lower guide track; and at least one locking element which is fastened to the first glass panel and configured to be coupled to the guide track, along which the locking element is movable when the first glass panel is moving. When coupled to the guide track, said locking element supports the first glass panel to prevent any movement caused by bending of the first glass panel in either one lateral direction or two opposite lateral directions with respect to the guide track.

According to an example said locking element is fastened to the middle section, one edge, both edges, the area of one edge, or the area of both edges, of the first glass panel.

According to an example, said guide track is fastened to a railing or structures of a railing, or the guide track is integrated in a railing.

According to an example, the glass panel system comprises a first and a second glass pan& which are placed one after the other and in the same plane, or which are placed in parallel and in different planes.

The presented solution has the advantage of preventing movements caused by bending of the glass panel. Consequently, wind, blasts, storms, and air flows have a smaller impact and cause a lighter load on the glass panel than before. The advantage is that for improving the strength, the glass panel does not need to be made thicker, or it can even be made thinner than before, compared with the case of prior art without the guide track and locking element according to the solution.

The presented solution makes it possible to move the glass panel and, in some examples, also to open it. In some examples, the presented solution makes it possible to prevent rising of the glass panel, whereby the glass panel remains in or on the lower guide track more steadily than before.

DESCRIPTION OF THE DRAWINGS

The solution presented will be described in greater detail in the following, with reference to the accompanying drawings.

DETAILED DESCRIPTION OF THE SOLUTION

In the figures, the same or corresponding parts are marked with the same reference number.

Figure 1:
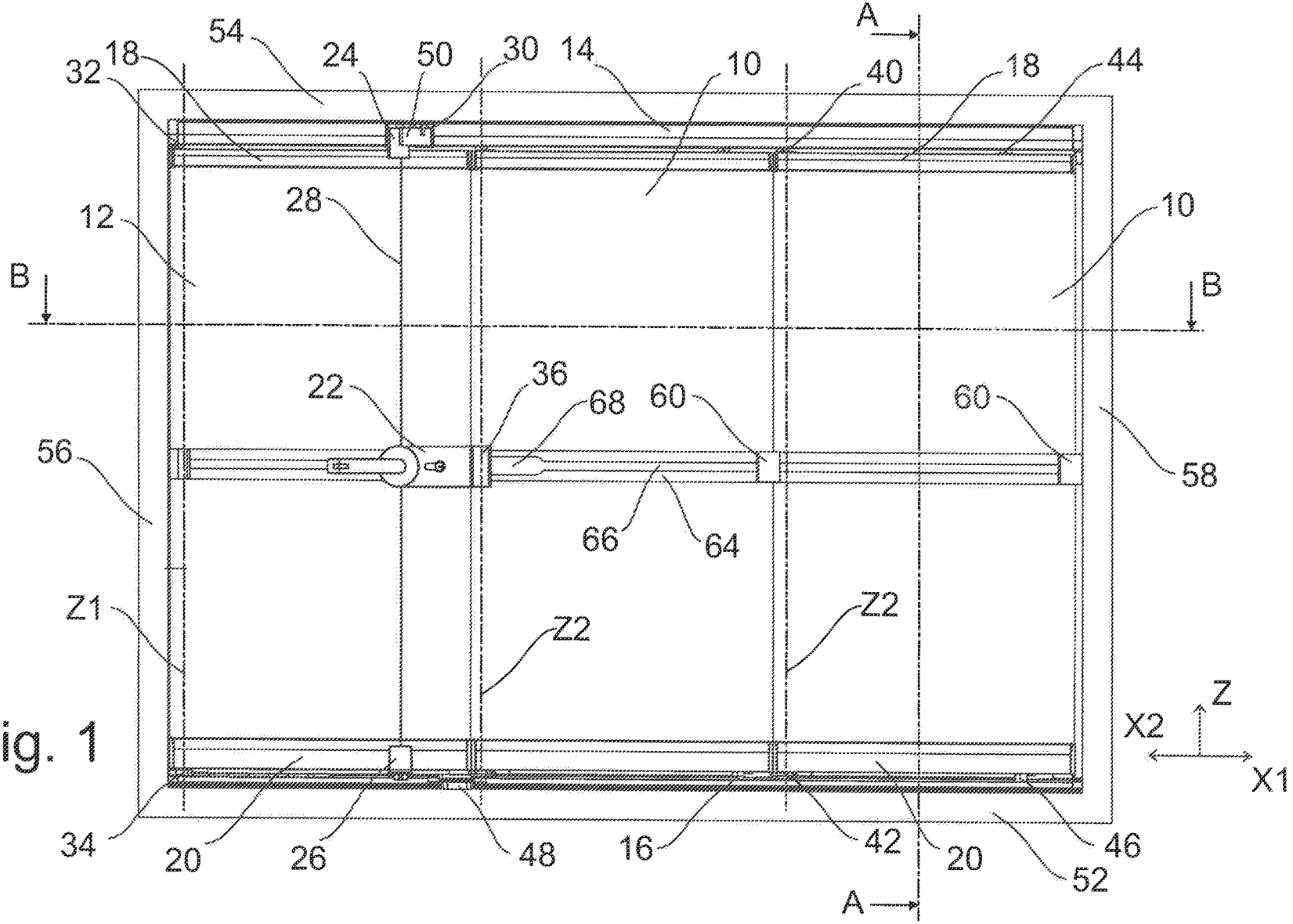
FIG. 1 shows a front view of an installed glass panel system to which the solution presented may be applied and which is vertical in its position of use, shown in the figure.

FIG. 1 shows an example of a glass panel system to which the solution presented may be applied. In FIG. 1, said glass panel system is installed and in its use position, whereby it is primarily vertical. In the following description, the glass panel system according to the presented solution will be described in its installed position, ready for use.

The glass panel system according to the presented solution may comprise one or more glass panels 10, a lower guide track 16, and an upper guide track 14. Each glass panel 10 is connected to the lower and upper guide tracks 14, 16 and is movable along the lower and upper guide tracks 14, 16. The glass panel 10 is movable in two opposite travel directions X1, X2 in the longitudinal direction of the lower and upper guide tracks 14, 16.

Said longitudinal direction is preferably horizontal. Preferably, the lower and upper guide tracks 14, 16 do not allow the glass panel 10 to move in two opposite lateral directions Y1, Y2, that is, in the direction transverse to the lower and upper guide tracks 14, 16, in terms of the horizontal plane.

Figures 4, 5:
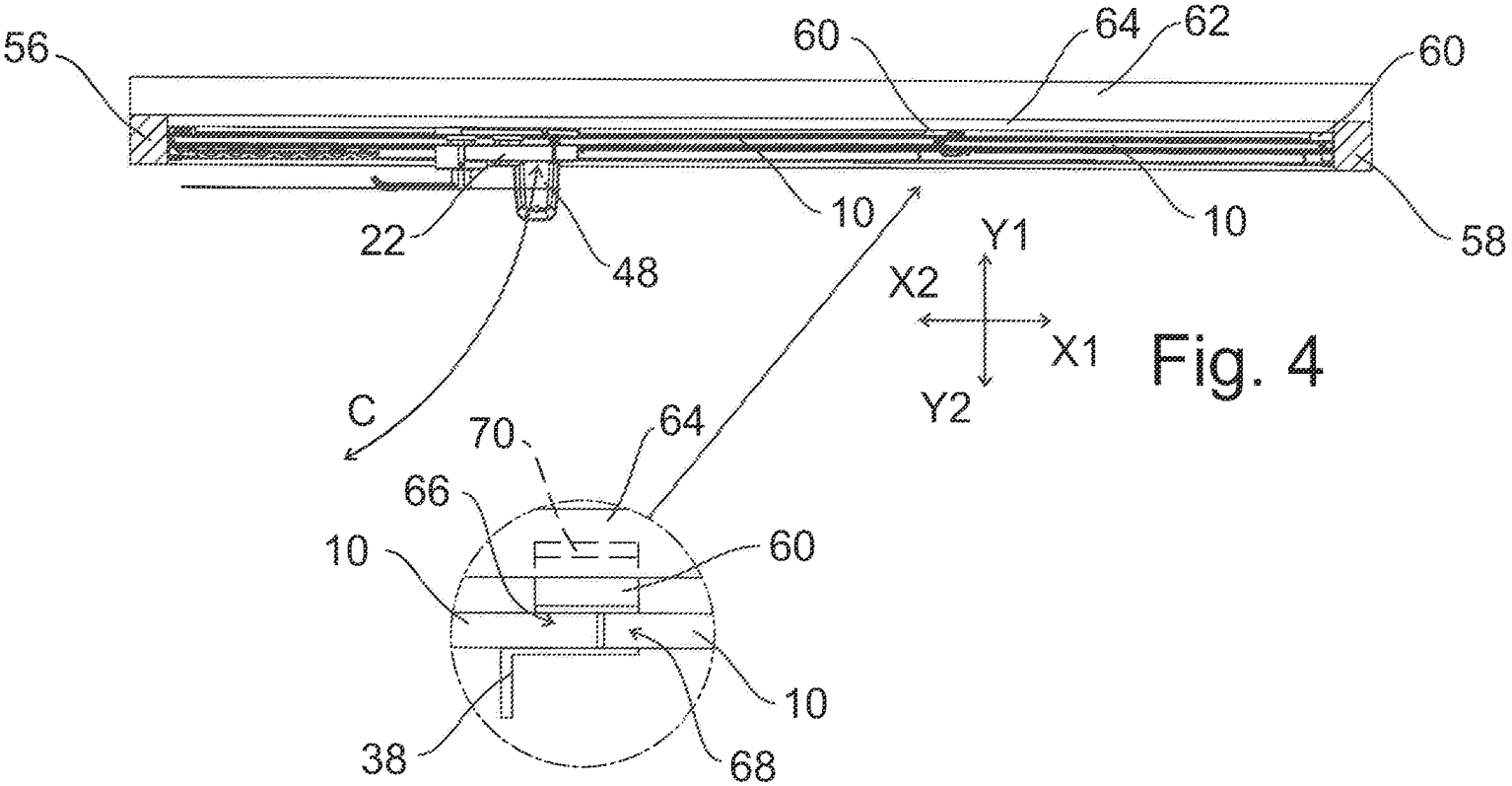
FIG. 4 shows a top view of the glass pan& system of FIG. 1, as a section at point B-B of FIG. 1.
FIG. 5 shows an enlarged detail of FIG. 4.
Figure 6:
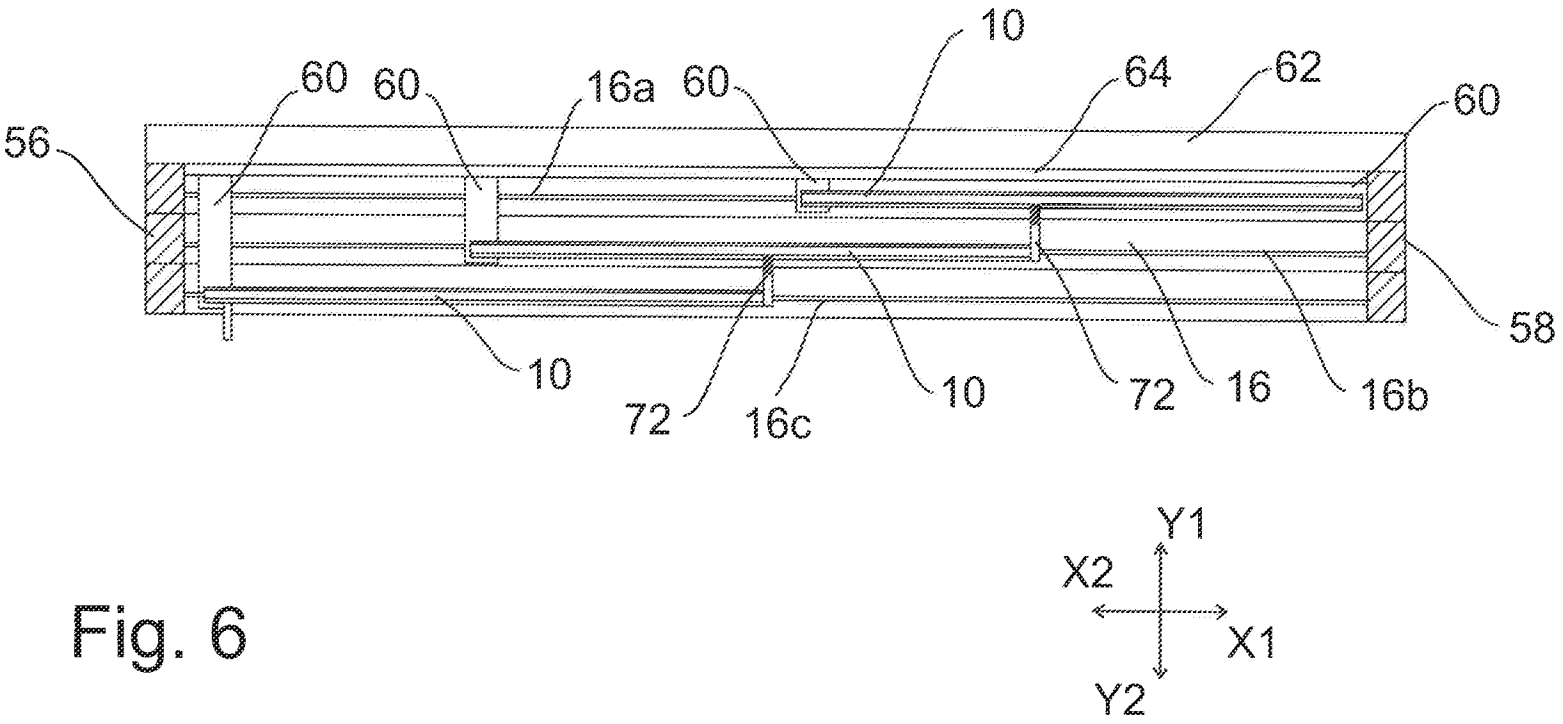
FIG. 6 shows a top view of an alternative embodiment of the glass panel system of FIG. 1.

In an alternative of the presented solution, in which two or more glass panels 10 are provided as shown in FIG. 4, the glass panels 10 are placed one after the other, when they are parallel with the lower and upper guide tracks 14, 16; in other words, they are placed in the same plane with each other. In a second alternative of the presented solution, in which two or more glass panels 10 are provided as shown in FIG. 6, the glass panels 10 are placed in different planes with respect to each other, when they are parallel with the lower and upper guide tracks 14, 16. In said second alternative, the glass panels may be placed in parallel, that is, in an at least partly overlapping manner, in terms of the lateral direction Y1, Y2.

At least one guide element 40, 44 may be connected to the top or the upper edge of the glass panel 10, for connecting the glass panel 10 to the upper guide track 14. The guide element 44 is spaced from the guide element 40. At least one guide element 42, 46 may be connected to the lower part or the lower edge of the glass panel 10, for connecting the glass panel 10 to the lower guide track 16. The guide element 46 is spaced from the guide element 42.

According to a first example, the upper guide track 14 supports the glass panel 10 and carries its weight, for example, by the guide elements 40, 44, whereby at least one guide element 42, 46 follows the lower guide track 16.

According to a second example and FIGS. 1 and 6, the lower guide track 16 supports the glass panel 10 and carries its weight, for example, by the guide elements 42, 46, whereby at least one guide element 40, 44 follows the upper guide track 16.

Figure 2:
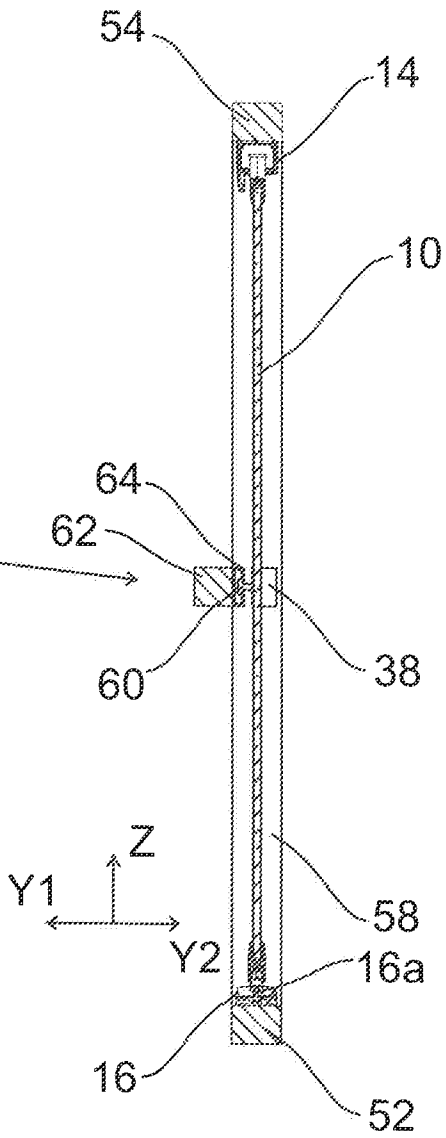
FIG. 2 shows the glass panel system of FIG. 1 in a side view, as a section at point A-A of FIG. 1.

As shown in FIG. 2, the lower guide track 16 supporting the glass panel 10 may comprise a single rail 16*a* which alone supports several successive glass panels 10 and carries their weight, and along which the guide element 42, 46 travels. As shown in FIG. 6, the lower guide track 16, supporting the glass panel 10, may comprise several rails 16*a*, 16*b*, 16*c* in parallel, each of which supports a single glass panel 10 and carries its weight, and along which the guide element 42, 46 travels. In both of the examples described above, the guide element 42, 46 may be, for example, a roller or a wheel.

According to an example and FIG. 1, the glass panel system may also comprise at least one glass panel 12 which is not movable along the lower and upper guide tracks 14, 16. The glass panel 12 is connected to the lower and upper guide tracks 14, 16.

The glass panel 12 is openable sideways (see direction of movement C) so that it pivots around a vertical rotation axis Z1. The rotation axis Z1 is substantially perpendicular to the longitudinal directions of the lower and upper guide tracks 14, 16. Furthermore, said rotation axis Z1 is located in the vicinity of one vertical edge of the glass panel 12. According to an example and FIG. 1, the glass panel 12 is openable to one side only (see direction of movement C).

At least one guide element 32 may be connected to the top or the upper edge of the glass panel, for connecting the glass panel 12 to the upper guide track 14. At least one guide element 34 may be connected to the bottom or the lower edge of the glass panel 12, for connecting the glass panel 12 to the lower guide track 16. The guide elements 32, 34 allow the glass panel 12 to be opened sideways. The rotation axis Z1 passes through the guide elements 32, 34. The guide elements 32, 34 may be locked to the upper guide track 14.

A single glass panel 10, either alone or together with one or more corresponding glass panels 10 and/or the glass panel 12, constitutes a wall, a window, or an openable passage. The presented glass panel system may also comprise a glass panel which corresponds to the glass panel 10 and may be coupled to the lower and upper guide tracks 14, 16 but is not movable.

The lower guide track 16 and the upper guide track 14, which are parallel, are located at a distance from one another and positioned vertically on top of one another. The glass panels 10, 12 are placed between the lower guide track 16 and the upper guide track 14 in such a way that the glass panels 10, 12 are vertical. The two opposite upright edges of the glass panel 10, 12 are vertical, and the upper and lower edges of the glass panel 10, 12 are horizontal. The lower guide track 16 may be fastened to a suitable surface, e.g. a floor, a door sill, or a window sill 52. The lower guide track 16 may be at least partly embedded in this surface, e.g. the floor. The upper guide track 14 may be fastened to a suitable surface, e.g. a ceiling, a structure installed below the ceiling, or the head 54 of a frame. According to an example and FIG. 1, the glass panels 10, 12 are delimited on one or both sides by a suitable surface, e.g. a wall, a structure fastened to a wall, or a jamb 56, 58.

According to an example and FIG. 1, the upper edge of the panel 12 may be provided with a lock element 24 which engages the upper guide track 14 and is spaced from the hinge element 32. For opening the glass panel 12, the lock element 24 can be disengaged and detached from the upper guide track 14. The lock element 24 is controlled, for example, by means of a cable, a chain, a wire, a bar, or the like 28.

According to an example and FIG. 1, a handle element 22 may be fastened to the glass panel 12. The handle element 22 may control the lock element 24, for example, by means of power conveyed by a cable, a chain, a wire, a bar, or the like 28. The lock element 24 is released by moving the handle element 22. The handle element 22 is, for example, a pivotable or rotatable handle or knob which is fastened to the glass panel 12, for example its middle section.

According to an example and FIG. 1, on the lower edge of the glass panel 12 may be equipped with a lock element 26 which engages the lower guide track 16 and is spaced from the hinge element 34. According to a first alternative, the lock element 26 is controlled, for example, by means of the handle element 22 and the cable, chain, wire, bar, or the like 28. According to another example, the handle element 22 is integrated in the lock element 26.

According to an example and FIGS. 1 and 4, the glass panel 10 may also be openable sideways (see direction of movement C) so that it pivots around the vertical rotation axis Z2. For opening, the panel 10 may be moved to a pre-determined point where, for example, the rotation axis Z1 and one or more rotation axes Z2 are close to one another. The rotation axis Z2 is substantially perpendicular to the longitudinal directions of the lower and upper guide tracks 14, 16. Furthermore, said rotation axis Z2 is located in the vicinity of one vertical edge of the glass panel 10. According to an example and FIG. 1, the glass panel 10 is openable to one side only (see direction of movement C).

If necessary, the guide elements 40, 42, 44, 46 are configured to allow the glass pan& 10 to be opened sideways. The rotation axis Z2 passes through the guide elements 40, 42.

The guide element 40 and/or the guide element 42 may be configured to be locked to the upper guide track 14, the lower guide track 16, a corresponding guide element 40, 42 of an adjacent glass panel 10, or a guide element 32, 34 of an adjacent glass panel 12 when the glass panel 10 is opened sideways. Thus, the above mentioned adjacent glass panel 10 and/or adjacent glass panel 12 are in the open position.

According to one example and FIG. 1, the upper edge of the glass panel 10, 12 may be equipped with a lath 18 to which the guide element 32, 40, 44 may be fixed, for example, with screws or nuts. The lower edge of the glass panel 10, 12 may be equipped with a lath 20 to which the guide element 34, 42, 46 may be fixed, for example, with screws or nuts. The lath 19, 20 forms a part of the glass panel 10, 12, for example, the lower edge or upper edge of the glass panel 10,12.

The upper guide track 14 may comprise an opening 30 allowing the guide element 44 to leave the upper guide track 14 and to detach from the upper guide track 14 when opening of the panel 10 is possible. An upper guide element 50 may be located by the opening 30 to support the guide element 44 leaving and re-entering the upper guide track 14. Preferably, the guide element 46 is also allowed to detach or draw away from the lower guide track 16 when opening of the panel 10 is possible.

The lower guide track 16 may comprise a brace element 48. The brace element 48 fixed by the side of the lower guide track 16 supports an opening glass panel 10 which has been moved to a predetermined point for opening the glass panel 10. The brace element 48 is thus at a distance from the guide element 42 of the opening panel 10.

The opened glass panels 10 are placed in parallel and in a bundle. Said bundle is typically placed on one side of a wall formed by glass panels 10, or an opening covered by them. The opened glass panel 12 is placed in parallel with the opened glass panel 10. One or more guide tracks may be provided as an extension to the lower guide track 16 and/or the upper guide track 14, to be used for moving the glass panels 10 so that they are placed in parallel and in a bundle. Thus, they are typically such glass panels 10 which cannot be opened sideways, and the glass panel 12 is left out. By means of said guide tracks, the glass panels 10 may also be moved farther away from said wall or opening.

According to the presented solution and FIGS. 1 and 6, the glass panel system may further comprise a guide track 64 which supports the glass panel 10 and is substantially horizontal and parallel with the upper guide track 14 and the lower guide track 16. The guide track 64 is placed by the side of the glass panel 10 and is, in the vertical direction Z, spaced from the upper guide track 14 and the lower guide track 16 as well as the upper and lower edges of the glass panel 10.

According to an example, the guide track 64 extends, in the vertical direction Z, to a distance of at least 600 mm or at least 800 mm, and not greater than 1500 mm or not greater than 1300 mm from the lower guide track 16 or the surface on which the lower guide track 16 is placed, either directly or via the sill 52. Said surface may be used as a base on which a person using the glass panel system stands or moves. According to a second example, the guide track 64 is placed at the height of the middle section of the glass panel 10. According to a third example, the guide track 64 is placed at the height of such a middle section of the glass panel 10 which covers not more than either one third or one fifth of the height of the glass panel 10, while its lower part and upper part each cover at least one third or two fifths of said height. According to a fourth example, the guide track 64 extends, in the vertical direction Z, to a distance of at least 500 mm or at least 700 mm from the upper and lower edges of the glass panel 10 or the lath 18, 20.

The guide track 64 is fastened at either one end or both ends to a suitable surface which is e.g. a wall, a structure fastened to a wall, or a jamb 56, 58. In addition, or alternatively, the guide track 64 may be fastened by one or more posts to a suitable surface, e.g. a floor, a door sill, or a window sill 52.

According to an example, the guide track 64 simultaneously constitutes a railing which may also be used as a handrail, for example a railing 62 as shown in FIGS. 2 and 6.

As shown in FIGS. 2 and 6, the above presented glass panel system may comprise the railing 62. The railing 62 may also be used as a handrail. The railing 62 is fastened at either one end or both ends to a suitable surface which is e.g. a wall, a structure fastened to a wall, or a jamb 56, 58. In addition, or alternatively, the railing 62 may be fastened by one or more railing posts to a suitable surface, e.g. a floor, a door sill, or a window sill 52.

According to an example and FIGS. 2 and 6, the guide track 64 is fastened to the railing 62, for example, in such a way that the above described dimensions are achieved. According to another example, the guide track 64 is fastened to the structures of the railing 62, such as one or more railing posts, for example, in such a way that the above described dimensions are achieved.

The railing 62 and/or the guide track 64 is placed preferably on that side of the glass panel 10, to which the glass panel 10 cannot be turned when opened, that is, in the lateral direction Y1.

According to the presented solution and FIGS. 4 and 6, at least one glass panel 10 is provided with a locking element 60 which is configured, when coupled to the guide track 64, to prevent the movement of the glass panel 10 in one or both lateral directions Y1, Y2, that is, in the direction transverse to the upper guide track 14 and the lower guide track 16. Said movement is caused by the bending of the glass panel 10 as a result of being loaded by e.g. wind, blasts, storms, or air flows.

When coupled to the guide track 64, the locking element 60 is movable along the guide track 64 while the glass panel 10 is moving along the upper and lower guide tracks 14, 16. The locking element 60 is movable in two opposite directions of movement X1, X2 in the longitudinal direction of the guide track 64.

The guide track 64 extends to one or more glass panels 10. The guide track 64 may also extend to the glass panel 12. The length of the guide track 64 is designed to be such that one or more glass panels 10 may be coupled to it, for example by means of the locking element 60.

Figure 3:
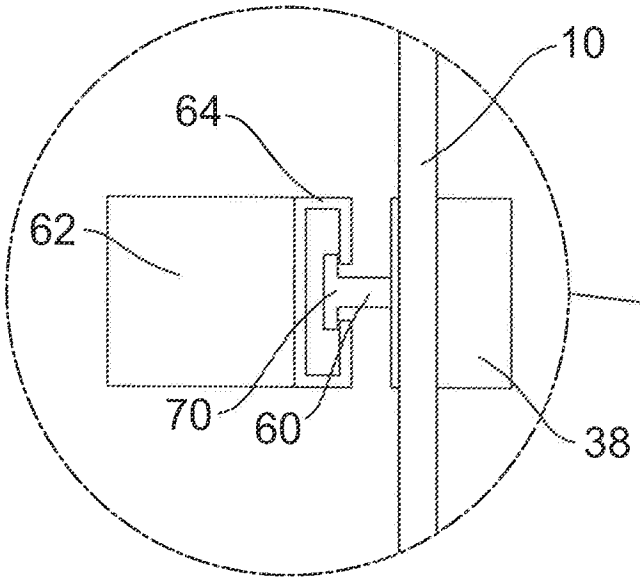
FIG. 3 shows an enlarged detail of FIG. 2

According to an example and FIG. 3, the locking element 60, for example its outermost end 70, has a shape which is locked to a shape in the guide track 64 so that the locking element 60 cannot detach form the guide track 64, seen in either one or both of the lateral directions Y1, Y2. Alternatively or additionally, the locking element 60 is configured to be placed against the guide track 64 so that the locking element 60 cannot move towards or away from the guide track 64, seen in either one or both of the lateral directions Y1, Y2. Preferably, the locking element 60 is at least not movable away from the guide track 64 in the lateral direction Y2. The principles presented in this example and FIG. 3 may also be applied in the alternative of FIG. 6.

For example, the end 70 is slidable along the guide track 64, or the end 70 is provided with a roller or a wheel which rolls along the guide track 64 when glass panel 10 moves along the upper and lower guide tracks 14, 16.

For example, the shape in the guide track 64 may be a groove, a slot or a recess, in which the end 70 is placed and which enables the coupling described above. According to another example, the shape in the guide track 64 is a structure or a flange extending substantially either upwards or downwards and behind which the end 70 is placed to enable the coupling described above. The above described groove, slot, recess, structure, and flange extend in the longitudinal direction of the guide track 64.

According to an example and FIG. 3, the end 70 is placed in a groove 66 in the guide track 64, to which the locking element 60 and its end 70 have access via the mouth of the groove 66. Said groove 66 and mouth extend in the longitudinal direction of the guide track 64. The end 70 is designed to be larger than the mouth so that the above described locking of the shapes is achieved in one or both of the lateral directions Y1, Y2.

According to an example, the end 70 is rotatable and is designed so that in one position, it fits to pass through said mouth of the groove 66, and in another, turned position, it does not fit to pass through said mouth, whereby the above described locking of the shapes is achieved when the end 70 is within the groove 66. In another example, the end 70 is rotatable and is designed so that in one position, it is turned away from behind the structure or flange of the guide track 64 so that it can move past said structure or flange, and in another, turned position, it is turned behind said structure or flange so that the above described locking of the shapes is achieved.

For the above described purpose, the end 70 may be fastened to the locking element 60 so that it is rotatable to said positions. Preferably, the end 70 is also lockable in at least said second position. For turning the end 70, the locking element 60 may be provided with, for example, a turnable or rotatable handle or knob.

A locking element 60 of the above described type, having a rotatable end 70, may also be fastened to the glass pan& 12. The locking element 60 may thus be part of the handle element 22 of the glass panel 12.

In the above described examples of the locking element 60 and the guide track 64, as an alternative or in addition to the support in the lateral direction Y1 and/or Y2, the locking element 60 may be configured to be placed against the guide track 64 so that the locking element 60 cannot rise, as regards the vertical direction Z. This is the case e.g. in the example of FIG. 3 where, in addition to being supported, the glass panel 10 can be prevented from coming off the lower guide track 16 or any of its rails 16*a*, 16*b*, 16*c*.

For opening the glass panel 10, 12 sideways (see direction of movement C), the locking element 60 has to be disengaged from the guide track 64.

In said disengaging, it is possible to utilize, for example, the rotatable end 70 of the locking element 60, as described above. According to another example, the guide track 64 is provided with a point to which the locking element 60 can move, to disengage from the guide track 64. Said point is provided, for example, in a groove, slot, recess, or flange of the guide track 64. Said point is also used when the locking element 60 engages the guide track 64 upon closing of the glass panel 10. Said point is arranged in such a place in the guide track 64, where the locking element 60 is when the glass panel 10 is positioned in the above described predetermined point so that the glass panel 10 can be opened sideways.

According to an example and FIG. 1, in the above described point, the mouth of the groove 66 of the guide track 64 is provided with a shape, such as an expansion 68, via which the end 70 of the locking element 60 can access the groove 66. According to another example, in the above described point, the guide track 64 is provided with a shape, such as an expansion, a neck or an opening, via which the locking element 60 can pass for engaging to and disengaging from the guide track 64. Said point is provided, for example, in a groove, slot, recess, or flange of the guide track 64.

When the closed glass panel 10 is moved along the lower and upper guide tracks 14, 16, the locking element 60 moves along the guide track 64 away from said point and engages the guide track 64 so that the above described supporting of the glass panel 10 to the guide track 64 is possible, and bending of the glass panel 10 is prevented.

According to an example and FIGS. 1 and 6, the locking element 60 is fastened to the flank, one edge or an edge section of the glass panel 10, for example its vertical edge. The locking element 60 may also be placed in the middle section of the glass panel 10. In the example of FIG. 1 where the glass panels 10 are placed one after another, the glass panel 10 may be provided with at least two locking elements 60 placed, for example, at both edges of the glass panel 10, or in the edge sections of both edges, for example the vertical edges. In the example of FIG. 6, in which the glass panels 10 are placed in parallel, the distance between each glass panel 10 and the guide track 64 varies, whereby the dimensions of the locking element 60 and/or its end 70 may vary.

As shown in FIG. 1, the locking element 60 may also be provided with a handle 38 which can be gripped to push the glass panel 10 along the upper and lower guide tracks 14. 16. Preferably, the handle 38 is placed on the opposite side of the glass panel 10 with respect to the guide track 64.

According to an example and FIG. 5, the locking element 60 is provided with a slot 66, in which the vertical edge of the glass panel 10 can be placed and fixed.

According to an example and FIG. 5, the locking element 60 fastened to the glass panel 10 is also configured to be supported to another glass panel 10 adjacent to it. In another example, the glass panel 10 is provided with not only the locking element 60 but also a separate supporting element which is configured to be supported to another, adjacent glass panel 10. Said supporting element is fastened to the side, one edge or edge area of the glass pan& 10, for example the vertical edge. Said locking element 60 or supporting element is provided for preventing the movement of the glass panel 10 in one or both of the lateral directions Y1, Y2.

According to an example and FIG. 6, the glass panel 10 is provided with not only the locking element 60 but also a vertical packing 72 placed between two glass panels 10. Said packing 72 is fastened to the flank, one edge or edge area of the glass panel 10, for example the vertical edge. The packing 72 is fastened to the glass panel 10 by means of, for example, a vertical lath which may be configured to stiffen the glass panel 10. The locking element 60 and the packing 72 may be placed at different edges of the glass panel 10, as shown in FIG. 6, or at the same edge. The packing 72 may even be configured to support another, adjacent glass panel 10.

According to an example and FIG. 5, the locking element 60 of the glass panel 10 is provided with a slot 68 in which the vertical edge of an adjacent glass panel 10 can be placed, for example, in such a way that one glass panel 10 is pushed along the upper and lower guide tracks 14, 16 next to the other glass panel 10.

As described in the examples above, it is possible to support the glass panel 10 to the guide track 64 by at least one locking element 60. Furthermore, said glass panel 10 can be supported to the guide track 64 either by the above-described supporting element and the locking element 60 of the adjacent glass panel 10, or merely by the locking element 60 of the adjacent glass panel 10.

The above described supporting of adjacent glass panels 10 to each other makes it possible that only one locking element 60 for each guide track 64 has to be fastened to each glass panel 10.

As shown in FIG. 1, the glass panel 10 may be provided with a supporting element 36, by which the glass panel 10 can be supported to the glass panel 12 or its handle element 22. The handle element 22 engages the supporting element 36 with e.g. a movable locking plunger. Moving the handle element 22 will release the handle element 22 from the supporting element 36.

In the glass panel system presented, two or more guide tracks may be placed at different height levels, the operation of each guide track being implemented in the same way as with the guide track 64 presented above. The functions of these guide tracks may thus differ from each other as well. Consequently, each glass panel 10 may be provided with two or more locking elements 60 at different heights, the operation of each locking element being implemented as described above.

The upper guide track 14 and/or the lower guide track 16, or the lath 18 and/or the lath 20, or the railing 62, or the guide track 64 are, according to one example, made of aluminium or an aluminium alloy, and have a continuous or elongated shape. It is possible to use other materials and metals as well.

The guide element 32, 34 or the guide element 40, 42, 44, 46 is preferably a piece made of a metal or plastic material, and other materials may be used as well.

According to one example, the glass panel 10, 12 is made of tempered glass. Other glass materials may be used as well. The glass panel 10, 12 may be a laminated structure. The glass panel 10, 12 is preferably transparent, but glass panels with an opaque treatment may also be used.

The solution presented is not limited only to the alternatives and examples shown in the accompanying figures or specifically disclosed in the foregoing description, or to which reference has been made in the description. The features disclosed in the foregoing may be combined and implemented in various combinations. For example, the principles of FIGS. 1 to 5 and the examples presented above may be applied in the example of FIG. 6, and vice versa.

The different embodiments of the presented solution are disclosed in the accompanying claims.

The invention claimed is:

1. A glass panel system comprising:

a lower guide track and an upper guide track which are substantially horizontal and parallel; and a first glass panel which is placed in a vertical position between the lower guide track and the upper guide track and coupled to the lower guide track and the upper guide track so that the first glass pan& is removable along the lower guide track and the upper guide track in their longitudinal direction;

a guide track placed by the side of the first glass panel and being substantially horizontal and parallel with the upper guide track and the lower guide track; and a locking element fastened to the first glass panel and configured to engage the guide track along which the locking element is movable when the first glass panel is moving; the locking element, when coupled to the guide track, supporting the first glass panel and provided for preventing movement caused by bending of the first glass panel, in either one lateral direction or two opposite lateral directions with respect to the guide track.

2. The glass panel system according to claim 1, wherein the guide track is placed next to the middle section of the glass panel.

3. The glass panel system according to claim 1, further comprising:

a second glass panel placed in the vertical direction between the lower guide track and the upper guide track and coupled to the lower guide track and the upper guide track in such a way that the second glass panel is movable along the lower guide track and the upper guide track in their longitudinal direction; and wherein the locking element fastened to the first glass panel is configured to be also supported to the second glass panel placed next to the first glass panel, and the locking element is, when supported to the second glass panel, configured to prevent movement caused by bending of the second glass panel in either one lateral direction or two opposite lateral directions with respect to the guide track.

4. The glass panel system according to claim 3, wherein the first and second glass panels are placed one after the other and in the same plane.

5. The glass panel system according to claim 1, further comprising:

a second glass panel placed in the vertical direction between the lower guide track and the upper guide track and coupled to the lower guide track and the upper guide track in such a way that the second glass panel is movable along the lower guide track and the upper guide track in their longitudinal direction; wherein the first and second glass panels are placed in parallel and in different planes; and wherein the locking element is fastened to one edge or one edge area of the first glass panel; and wherein another locking element is fastened to one edge or one edge area of the second glass panel.

6. The glass panel system according to claim 1, wherein said locking element is fastened to the middle section, one edge, both edges, one edge area, or both edge areas of the first glass panel.

7. The glass panel system according to claim 1, wherein the glass panel system further comprises a railing, and wherein the guide track is fastened to the railing or structures of the railing, or the guide track constitutes part of the railing.

8. The glass panel system according to claim 1, wherein the locking element comprises an outermost end having a shape designed to be locked in a shape in the guide track in such a way that the locking element cannot disengage from the guide track, seen in either one or both of said lateral directions.

9. The glass panel system according to claim 8, wherein the shape in the guide track is a groove, a slot, or a recess which the end of the locking element can engage.

10. The glass panel system according to claim 8, wherein the shape in the guide track is a structure or a flange which extends substantially either upwards or downwards and behind which the end of the locking element is placeable.

11. The glass panel system according to claim 8, wherein the guide track has a shape via which the locking element has access to the inside of the guide track, for engaging with and disengaging from the guide track.

12. The glass panel system according to claim 1, wherein the locking element, when engaged with the guide track, is configured to prevent the first glass panel from rising vertically upwards with respect to the lower guide track.

13. The glass panel system according to claim 1, further comprising:

a third glass panel placed in the vertical direction between the lower guide track (16) and the upper guide track, and coupled to the lower guide track and the upper guide track in such a way that the third glass panel is openable by turning sideways.

14. The glass panel system according to claim 1, wherein the first glass panel is openable by turning sideways when the first glass panel is placed in a predetermined point for opening.

15. The glass panel system according to claim 1, wherein the guide track is placed in the vertical direction to a distance of at least 500 mm or at least 700 mm, from the upper and lower edges of the glass panel.

16. The glass panel system according to claim 1, wherein the guide track is placed in the vertical direction to a distance of at least 600 mm or at least 800 mm and not greater than 1500 mm or not greater than 1300 mm from the lower guide track or the surface on which the lower guide track is placed.

17. The glass panel system according to claim 1, wherein the guide track is placed by the side of the first glass panel and is, in the vertical direction, spaced from the upper guide track and the lower guide track and the upper and lower edges of the first glass panel.

18. The glass panel system according to claim 2, wherein the glass panel system further comprises a railing, and wherein the guide track is fastened to the railing or structures of the railing, or the guide track constitutes part of the railing.

19. The glass panel system according to claim 15, wherein the glass panel system further comprises a railing, and wherein the guide track is fastened to the railing or structures of the railing, or the guide track constitutes part of the railing.

20. The glass panel system according to claim 16, wherein the glass panel system further comprises a railing, and wherein the guide track is fastened to the railing or structures of the railing, or the guide track constitutes part of the railing.

* * * * *